United States Patent [19]

Meredith

[11] Patent Number: 4,750,419

[45] Date of Patent: Jun. 14, 1988

[54] PROCESS AND A MACHINE FOR PRINTING ON ARTICLES BY SILK SCREENING

[76] Inventor: Steven A. Meredith, 169 Main St., West Newbury, Mass. 01985

[21] Appl. No.: 842,843

[22] Filed: Mar. 24, 1986

[51] Int. Cl.[4] ..... B41F 17/22

[52] U.S. Cl. ..... 101/40; 101/124; 101/126; 101/129

[58] Field of Search ..... 101/124, 123, 126, 129, 101/38 R, 38 A, 39, 40, 35

[56] References Cited

U.S. PATENT DOCUMENTS

| | | | |
|---|---|---|---|
| 2,125,837 | 8/1938 | Schneider et al. | 101/40 X |
| 2,198,565 | 4/1940 | Schutz et al. | 101/124 |
| 2,461,281 | 2/1949 | Jackson et al. | 101/123 |
| 2,553,085 | 5/1951 | Groce | 101/124 X |
| 3,181,457 | 5/1965 | Eldred et al. | 101/124 |
| 3,269,305 | 8/1966 | Rossi | 101/123 X |

*Primary Examiner*—Clifford D. Crowder

*Attorney, Agent, or Firm*—Wenderoth, Lind & Ponack

[57] ABSTRACT

In the course of continuous movement along a track that is essentially circular, articles undergoing an imprinting process are passed through a plurality of print stations, individual silk screen stencils at the stations being adjusted to the resulting changes in the position of the article that occur during the imprinting process as the article moves through the printing machine. The articles can be arranged with their longitudinal axes either horizontal or vertical during the imprinting process. It is also possible to introduce the articles into the machine with their longitudinal axes vertical, then move them into a position in which their longitudinal axes are horizontal and imprint them in such a position, and then bring the imprinted articles once again into a position in which their longitudinal axes are vertical so that they leave the machine in this position.

20 Claims, 5 Drawing Sheets

PROCESS AND A MACHINE FOR PRINTING ON ARTICLES BY SILK SCREENING

The present invention relates to a process and a device for printing on articles by silk screen printing. The device has at least one processing station for the articles, which articles are held by a carrier that is in each instance moved along a revolving track and then released by this carrier after passing at least one processing station.

It is known that articles can be imprinted during continuous passage through a silk screening machine. In one known case, this involves an article transporting track in which a chain passes between two sprockets, the printing process being completed in appropriate stations. This prior design entails the disadvantage that the printing machine is relatively long in those cases when several colours are to be applied, with the result that the machine is difficult to monitor and may require several operators. Such a disadvantage is not encountered in general in such known machines in which the articles are moved from one processing station to another in a circular path. However, the throughput of such machines is relatively low, since there is no progressive motion through the machine during the time that is required for processing the articles.

It is the aim of the present invention to provide a machine and a process of the kind described in the introduction hereto such that the disadvantages found in known machines are reduced or avoided. In particular, the invention seeks to achieve a compact design and still retain a relatively high throughput rate.

A further object of the present invention is to provide a process and a machine which will make it generally economically feasible to print a small run of articles at a high throughput rate.

A further preferred object of the present invention is to make it possible that, regardless of the position of the objects to be printed during the printing process, the articles can be introduced into the printing machine and removed from it in a position that conforms to the position adopted by the articles in the devices that are incorporated before and/or after the printing device. These can be, for example, devices used for producing, ordering, filling, closing containers that are imprinted in the machine.

These and other tasks have been solved, in that the articles are moved continuously along the track, that squeegee rakes or silk screen stencils are moved synchronously with the articles to be imprinted during the printing process, and that complementary squeegee rakes or silk screen stencils are matched during the printing process to the changes in the position of the article that take place as the article moves around a circular track.

The machine of the present invention can be incorporated without great difficulty into an existing processing system along which articles also move continuously. The matching of the silk screen stencils to the position of the article during impression allows for the fact that the article moves forward continuously when being printed, and does so not in a linear progression, but along a circular path.

The necessity of adapting the position of the silk screen stencil to the position of the article during the printing process exists regardless of whether the article is to be imprinted when vertical or horizontal. In the former case, it is important that the angular position of the stencil, that is essentially vertical, will have to be so adapted to the position of the article to be imprinted that the principal plane of the stencil is essentially tangential to that surface of the article that is to be imprinted.

In the case of imprinting an article that is horizontal it is also important that the silk screen stencil retains its angular position to the article or to the surface that is to be imprinted during the printing process. In general, in the case of printing on a curved article such as a bottle or the like, this means that the silk screen stencil that is arranged essentially in the horizontal plane will be displaced during the printing process in the horizontal plane, about the center point of the track. Should it be necessary, in both cases the silk screen stencil can be moved additionally to this pivoting movement, in its principal plane perpendicularly to the axis of rotation of the object, relative to this, in which connection it then moves along a circular path that is parallel to the arc described by the article during the printing process. Thus there will always be a synchronized motion between the circumferential speed of the rotating article, and the travelling screen speed so that there will result no slippage between the screen and article surface.

Thus movement of the silk screen stencil to match the circular path followed by the article would not be necessary if the imprinted image in the stencil were to be formed according to the circular path followed by the article, which is to say, in the form of sections. However, a prerequisite for this is a distorted configuration of the print image in the stencil, in order to compensate for the differing angular velocities that occur along the axis of rotation of the article. The configuration of a print image that is distorted in the stencil in this manner always entails difficulties, so that the possibility—provided by the present invention—of moving the stencil along a linear section of its path relative to the article during the printing process is to be preferred, since this makes it possible to use an undistorted image in the silk screen stencil, one which corresponds completely, across its whole extent, to the image that is to be transferred to the article.

Furthermore, the present invention provides the possibility that the longitudinal axis of the article may be essentially vertical when the article is introduced into the machine and that once it is in the machine the article may be brought to a position in which its longitudinal axis is essentially horizontal, and that after termination of the printing process it will be returned to a position in which its longitudinal axis is once again essentially vertical. This provides the advantage that the objects to be printed are moved into the machine when they are upright, and removed from the machine when upright, although the imprinting process as such can be completed on surfaces that are parallel to an axis that is essentially horizontal. This makes it possible to use silk screen stencils that are in an essentially horizontal plane, which can be a decided advantage in certain applications, e.g., depending on the characteristics of the printing ink that is used.

In this regard, depending on the shape of the article that is to be imprinted, it may be desirable or even essential that the article be additionally supported by a support during movement along a portion of its path along the track, the support acting on the article at a distance from the article carrier and moving synchronously with the article that is to be imprinted while it is supporting said article. This additional support can move with the particular carrier that is in use. In this case, the number of additional supports can correspond to the number of carriers. On the other hand, if light articles are involved it may be advantageous that each article be held on one side only, at least on sections of the track between processing stations and be supported by an additional support in a processing station, in this case said additional support engaging with the article immediately prior to the start of the processing, then moving synchronously with the article and the carrier, and then moving back to its starting position after termination of the processing, so that an additional support of this kind moves back and forth along the track. It is advantageous if an additional support is available only in the stations within which the article is processed. This procedural method is based on the idea that plastic articles, which weigh very little, can be held easily during movement by a carrier that acts only on one side of such articles. On the other hand, within the processing stations where, for example, a squeegee rake exerts a specific pressure on the article during a printing process, the article is best supported on both sides. This configuration, in which an additional support is provided in the processing stations but does not move with the objects beyond the station and which completes a back and forth movement, and which for this reason only supports the article in the processing station for a specific interval of time that in general corresponds to the time required to complete the processing, provides the advantage that the number of these additional supports is far smaller than the number of carriers and thereby the number of articles that are in the machine at a specific time. This makes the machine less costly and simpler, since the investment costs are smaller than is the case for conventional configurations in which the object is supported by two devices for the whole of its passage through the machine. In addition, there is the fact that when a change is made from articles of one kind to articles of another kind, which generally requires a change of carriers and supports, the time required for replacing the components is considerably shorter.

The necessity for providing an additional support is eliminated if the articles to be imprinted are for example, like cups that can be slid onto a mandrel having outside dimensions that correspond to the inside dimensions of the articles themselves.

The carrier and/or supports can be arranged so as to be able to rotate about the longitudinal axis of the articles that they hold. This can be advantageous in the case of multiple printing since it makes it possible to rotate the article to the correct starting position prior to the start of the subsequent printing process.

It is advantageous if the carriers are in turn borne on a ring mounting that rotates continuously about a vertical axis, this ring being supported on the frame of the machine. Additional supports and squeegee rakes can be borne on a supporting element that is pivotable on a circular track. The silk screen stencil that is in each case associated with it can be supported on the carrier element in such a manner as to be able to slide relative to the carrier element, in which regard it can be advantageous to provide a drive for the silk screen stencil, which drive is independent of the carrier, and which makes it possible to move the silk screen stencil regardless of the movement of the carrier and the movement of the article that is to be imprinted relative to this, in a plane perpendicular to its axis of rotation. In the situation where it is desired to print on flat rather than curved articles, it will be understood that the squeegee rakes and silk screen stencil are transposed to each other's position. Further, it is advantageous to arrange the additional support on the carrier such that it can slide back and forth in the direction of the longitudinal axis of the article that is supported by it, such that it engages without difficulty with the article to be supported and can be disengaged from said article when the support function is terminated.

The carrier can be mounted so as to be able to pivot, in such a manner that the article held by it can pivot between a plane that is essentially horizontal and a plane that is essentially vertical.

The following is a description by way of example of certain embodiments of the present invention reference being had to the accompanying drawings in which.

Figure 1:
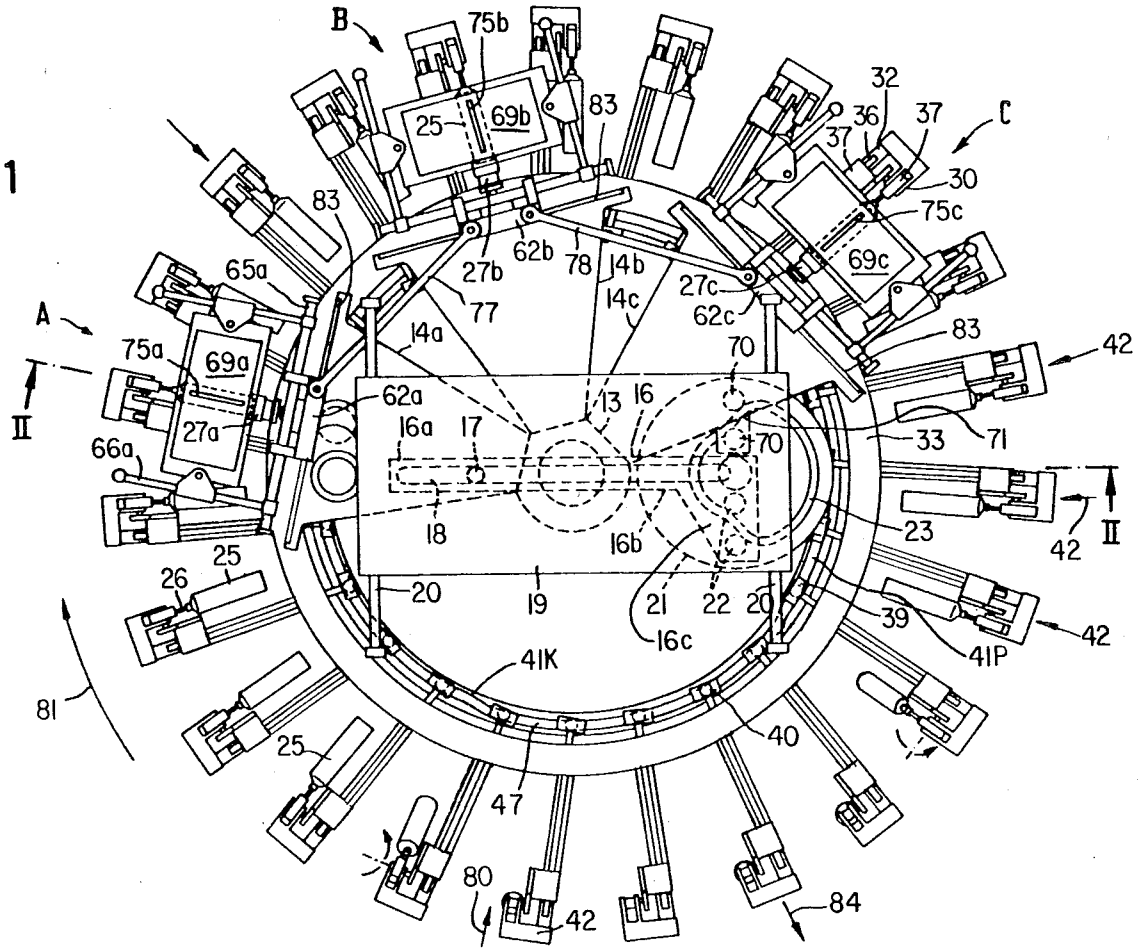
FIG. 1 is a schematic diagram of a silk screen machine in which certain parts have been omitted for purposes of clarity.
Figure 2:
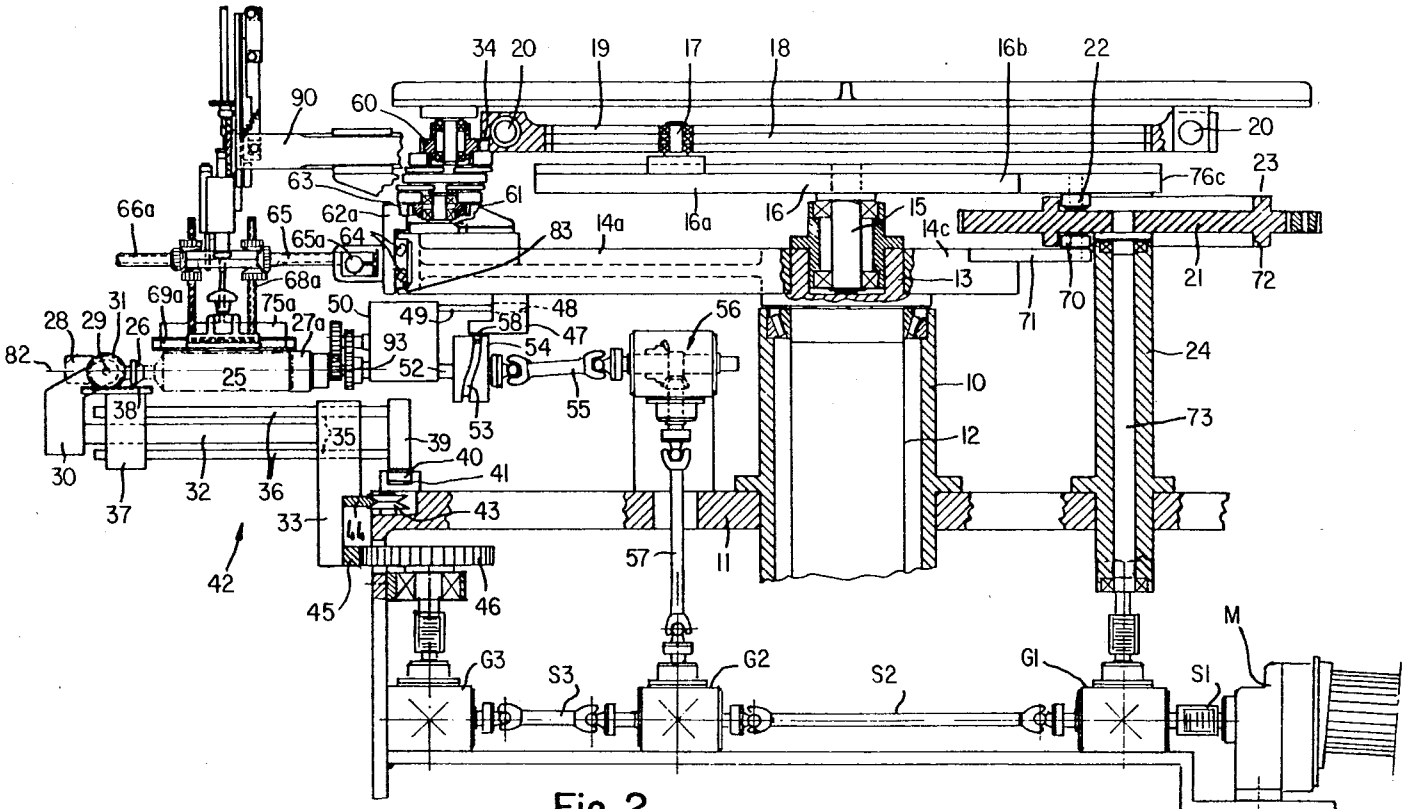
FIG. 2 is a cross-section on the line II—II in FIG. 1.

The printing machine that is shown in FIGS. 1 and 2 has a central, hollow vertical column 10 that is connected rigidly to the machine frame 11. Within the column 10 there is a shaft 12 that has a hub 13 at its upper end, three arms, or spokes, **14*a*, 14*b* and 14*c* being arranged at a radial distance from each other on this hub and extending perpendicularly to the shaft 12 in a plane that is essentially horizontal. The carrier arm 14*c* is fitted with two cam followers 70, one of which is attached to an extension 71 of the carrier arm 14*c*. Both cam followers 70 work in conjunction with a profiled (see FIG. 1) cam track 72 that is attached to the underside of a pinion 21 that extends in a plane that is essentially horizontal. The pinion 21 with the cam track 72 is driven by motor M through gearbox G1 and shaft 73. Because of the profile of the cam track 72, rotation of the pinion 21 results in a back and forth rocking motion being transmitted by the cam track 72 to the carrier arms 14*a*, 14*b*, and 14*c* on the hub 13, as the followers 70 follow the driven cam track 72**.

An upright shaft 15 is supported, coaxially with the shaft 12 in such a manner as to be able to rotate relative to it, within its hub 13. A double-arm lever 16 is mounted on the shaft 15. One arm **16*a* of the lever 16 carries an adjustable position peg 17 at its upper end, and this peg engages in a linear guide 18 of a slide plate 19 mounted above the arm 16. The plate 19 is supported on two rods 20 transversely to the guide 18 such that it can move back and forth on the machine. The rods 20 are connected to the machine frame and act as guides for the plate 19**.

The second arm 16b of the lever 16 has a lateral extension 16c at its free end, and this extension has two cam followers 22 on its underside which followers 22 work in conjunction with a cam track 23. This cam track 23 is mounted on the upper side of the pinion 21 and is the same shape as the cam track 72.

The slide plate 19 has a toothed rail, or rack, 34 along one side (see FIG. 2) and when the plate 19 moves, this drives a cog, or pinion, 60 that is connected rigidly to a second cog 61 beneath it, which, in its turn, meshes with a toothed rail, or rack, 63 that is attached to a stencil slide plate 62a that supports a silk screen stencil 69a. The stencil slide plate 62a is supported at the face side of the carrier arm 14a through a sliding bearing 64 along a linear guide 83 (see FIG. 3A) that is parallel to a tangent to the path of movement of the article 25 to be printed on. The connection between the screen slide 62a and the associated silk screen stencil 69a is made through adjustable arms 65a, 66a, and the holder 68a.

The machine that is shown in FIGS. 1 and 2 is provided with three print stations A, B, and C, each configured in an identical manner, each of the print stations being associated with one of the carrier arms 14a, 14b, and 14c, respectively. The stations A, B and C could be used for example to apply different colors. Each of the silk screen stencils 69b and 69c associated respectively with the arms 14b and 14c, is driven by the screen slide 62a of the stencil 69a of print station A. To this end, the screen slide 62a is connected to the screen slide 62b through a flexibly mounted rod 77 and this rod is connected in its turn to the screen slide 62c through a flexibly attached second rod 78. In total, this ensures a synchronous movement of all the screenslides 62a, 62b, and 62c as well as of the stencils 69a, 69b and 69c.

Because of profile of the cam track 23, rotation of the pinion 21 results in a reciprocal pivoting movement of the double-arm lever 16; this movement is transmitted through the pin 17 to the slide plate 19 and results in its turn in the back and forth linear and reciprocal movement of the slide plate 19 along guides 20. The magnitude of the stroke completed by the slide plate 19 is thus dependent on the distance of the pin 17 from the shaft 15. If the pin 17 is located so as to be coaxial with the shaft 15 this results only in a rotation of pin 17 about its longitudinal axis, so that the position of the slide plate 19 remains unchanged, and it remains stationary. On the other hand, the stroke completed by the slide plate 19 increases with an increase in the distance between the pin 17 and the shaft 15. Negative effects can, if desired, be produced by positioning the pin 17 on the opposite side of shaft 15.

Each of the arms 14a, 14b, and 14c also serves, through extension 90, as a mounting for the squeegee rakes 75a, 75b, and 75c, each of which is associated in the conventional manner with a silk screen stencil 69a, 69b, and 69c. The squeegee can be moved closer or further away, relative to the silk screen stencil by operating screw threaded rods 68a in order to adapt to the shape and size of the articles to be imprinted. These are conventional configurations and for this reason details have been omitted from the drawings.

The exemplary version shown in the drawings is used to imprint bottle-like articles 25, these articles being supported by a mandrel 26 which, when in its effective operating position, engages in the neck of the bottle 25, and by a support 27a (see FIG. 2). The support 27a is provided with a seat for the bottom end section of the individual bottle 25. The mandrel-like carrier 26 is connected rigidly to a shaft that is installed in a fork mounting 30 and connected rigidly to a cog 31. The fork mounting 30 is, in its turn, supported on a rod 32 that is approximately radial relative to the column 10, this rod 32 being secured to a ring 33 that is coaxial with the column 10. The upper portion of the ring 33 is provided with two approximately radial drilled holes 35, each of which serves to support an operating rod 36. At their ends that face the mounting 30, the operating rods 36 are connected rigidly to a crosspiece 37, this having an aperture for the rod 32, along which it moves. The crosspiece 37 bears, on its upper portion, a toothed rod, or rack, 38 that engages with a cog, or pinion 31.

At their other ends the two operating rods 36 are connected by a crosspiece 39 that has a cam follower 40 on its underside, this engages in a fixed cam plate 41 that extends around the outer periphery of the machine frame 11.

The ring 33, that supports a plurality of the units 42, consisting in the main of the components 26 and 29 to 32, and 35 to 39, is in its turn supported by a plurality of spaced V-rollers 43 that are mounted circumferentially on the machine frame 11, and which protrude adjacent the circumference of the ring 33. A rotating V-rail 44 is attached to the ring 33 and supportingly engages in the V-rollers 43. On its lower end, the ring 33 is provided with a rotating toothed rack 45 that meshes with a continuously rotating driving pinion 46 which drives the ring 33 and its units 42, continuously through the printing stations A, B, and C. As seen in FIG. 2 the pinion 46 is driven by motor M through shaft S3 and gearbox G3.

Each of the carrier arms 14a, 14b, and 14c has on its underside, close to its free end, a guide block 47 that is provided with a through hole 48, and this serves as a guideway for a rod 49. The latter supports a housing 50, within which there is a gear system by means of which the support 27a can be rotated about the longitudinal axis of the article 25. The drive for the gear system arranged within the housing 50 is provided through a shaft 52 to which is rigidly attached a cam 54 that bears a cam scrole 53. The shaft 52 is driven by a bevel gear 56 and a cardan shaft 55 that can be length compensated, through a shaft 57. The shaft 57 is driven by motor M through shaft S2 and gearbox G2. A cam follower 58 engages in the cam scrole 53, said cam follower being supported by the stationary guide block 47. Engagement between cam scrole 53 and follower 58 results in a back and forth reciprocating movement of the parts supported by the shaft 52 and the guide rod 49, and thus, in particular, of the support 27a in the direction of the longitudinal axis of the article 25. Support 27a is also turned about a longitudinal axis 82 of the article.

The method of operation of the silk screen machine illustrated in FIGS. 1 and 2 will be described below:

The articles 25 to be imprinted, in this case plastic bottles, are placed, upright, in the station 80 (FIG. 1) of the machine; the mandrel-like carrier 26 of the unit 42 that is currently in this position has been pivotted to the upright position by the action imparted to cam follower 40 by the path of the cam plate 41, before arriving at station 80. That is to say, the profile of cam plate 41 causes movement of cam follower 40 and this action is transferred to slide block 37 whose rack 38 actuates pinion 31, so that the upright bottle can be slid upwards against the carrier 26, whereupon the carrier 26, because of its mandrel-like configuration, engages in the neck of the bottle. If a vacuum is applied through the carrier 26, provided with a drilled hole for this purpose, which can be connected to a vacuum source, the bottle 25 can be kept suspended from the carrier 26. In the course of continued rotation of the ring 33 in the direction of the arrow 81, and thus of the units 42 that are supported on the ring 33, the bottle 25 arrives at print station A. Prior to reaching this point appropriate rotation of the mandrel-like carrier 26 by the action imparted by the path 41k of the cam plate 41 to cam follower 40, moves the bottle into a position that is essentially horizontal. In this regard, it is possible to incorporate additional processing stations prior to print station A, in which, for example, a dust removal station where dust is removed from the bottle, a treatment station where it is subjected to flame treatment, or is otherwise prepared for the printing process.

At the moment the bottle 25 arrives in the area of the print station A, the carrier arms **14*a* to 14*c* have been pivotted into their end positions opposite the direction of rotation 81, under the action of cam face 72 and followers 70, and the supports 27*a* to 27*c* have taken up their rear-most position, furthest from the bottle 25. As soon as the particular bottle approaches a print station, A, B, or C, the appropriate support 27*a*-27*c* is thrust outwards by motion imparted by the cam face 53, whereupon the arms 14*a*–14*c* simultaneously move synchronously with the movement of the ring 33, with the result that the support 27*a*, as shown in FIGS. 1 and 2, engages the base end of the bottle 25. The engagement process must be completed at approximately the time that corresponds to the position of the components shown in FIG. 3A (which have been moved there by motion imparted by the cam 23 and its followers 22) since at this stage, once the squeegee 75*a* has been lowered in conventional manner to the silk screen stencil, the printing process begins. Thus it is not necessary to lower the silk screen stencil specially onto the article 25** that is to be imprinted, since the existing difference in height can be bridged, generally speaking, by the flexing of the stencil that is caused by the pressure applied by the squeegee.

In order to print an impression from the silk screens **69*a* onto the surface of the rotating bottle 25, it is necessary for the squeegee 75*a* to keep station with the bottle, and this it does because it moves with extension 90 of arm 14*a*, and for the silk screen 69*a* to move relatively to the squeegee and to the bottle, in a direction opposite to the direction 81 to compensate for movement of the bottle. That is to say, since the bottle 25 is moved on a circular track beneath the silk screen stencil and thus constantly changes its radial angular position relative to its axis of rotation, it is necessary to change the radial position of the silk screen stencil 69*a* correspondingly during the printing process. The positions of the parts that work in conjunction with each other, which result from this, is shown in the FIGS. 3A to 3C, and in FIG. 4. In FIG. 4 it is assumed for the purpose of illustration, that the silk screen stencil 69*a* is pivotted with arm 14*a* and simultaneously displaced on it in the direction of the longitudinal axis of the stencil 69*a*, perpendicular to the axis of rotation of the bottle 25. Thus, the position of the stencil 69*a* in the direction of the machine's circumference, remains unchanged, so that it is only pivotted from the starting position 'a', through a centre position 'b', to an end position 'c', as is shown in FIG. 4, this being done in coordination with the simultaneously occurring movement of the bottle 25 that is to be imprinted, which moves in the direction indicated by the arrow 81 in FIG. 1, and so that the direction of the axis of rotation 82 of the bottle 25 does not change in relation to the longitudinal axis of the stencil 69*a*** throughout the printing process.

Figure 3A:
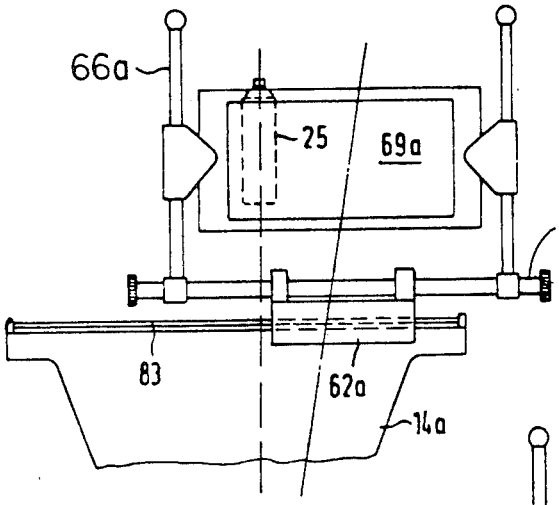
FIGS. 3A to 3C are plan views, in three separate drawings, of a silk screen stencil arranged essentially in three horizontal planes, in three successive relative positions of the stencil and the article during the printing process.
Figure 3B:
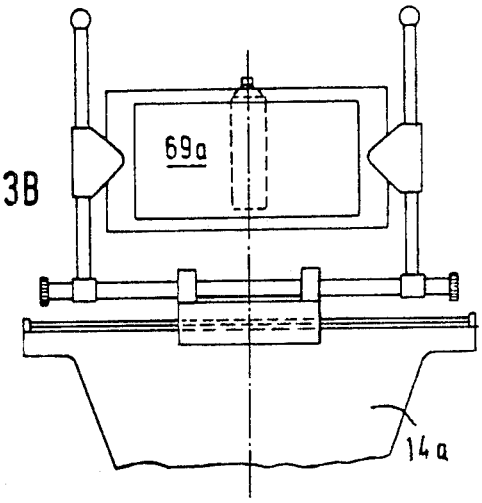
Figure 3C:
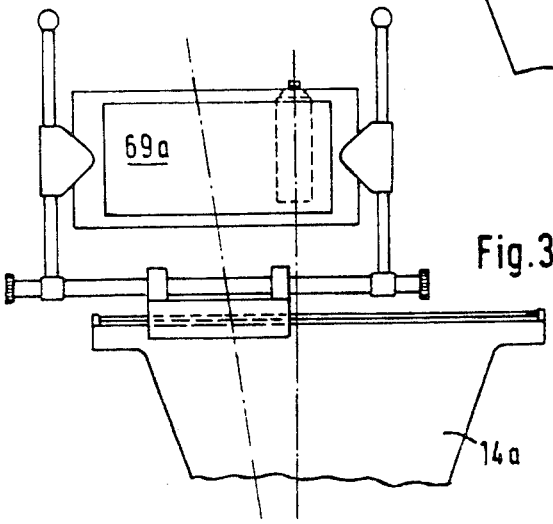
Figure 4:
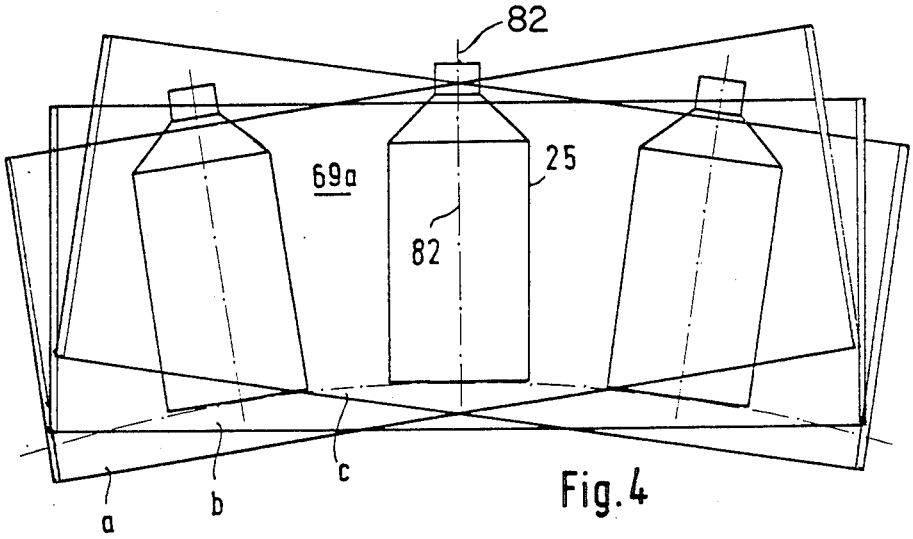
FIG. 4 is a schematic representation of the silk screen stencil and article as in FIGS. 3A to 3C, in a comprehensive drawing.

FIGS. 3A–3C show that this action can be achieved in a simple manner. The silk screen stencil **69*a* is movable along a linear guide 83 on the face side of the arm 14*a* and relative to it, while the carrier arm 14*a* carries out its synchronous rotation with the ring 33 in the direction of arrow 81, during the printing process. This movement is achieved because since the position of the stencil slide 62*a* is fixed in the direction of the circumference by appropriate adjustment of the pin 17, all that is possible is a tangential reciprocating movement, approximating a pivotting movement, of the slide 62*a* approximately about the point of rotation of the ring 33. This movement is transmitted to slide 62*a* by the engagement between the cog 61 and the toothed rod 63 on the screen slide 62*a*. Because of the fact that the track 83, along which the screen slide 62*a* moves with the arm 14*a*, is linear, the movement is transferred to the stencil 69*a*, with the result—discussed above—that there is continuous adaptation to the changing angular position of the article 25. FIGS. 3A to 3C show that during the printing process, if all the above prerequisites are met, the arm 14*a* slides along the stationary screen slide 62*a*** its angular position changing continuous as this happens.

In addition to functioning as described above, it is possible, by appropriate adjustment of the pin 17 on the silk screen stencil **69*a* to transfer a lateral movement to the silk screen stencil, perpendicular to the axis of rotation 82 of the bottle 25 in order to compensate, for example, for differences between the circumferential speed of the bottle rotating around the axis 82 and the lateral velocity of the bottle as it moves in the direction of the arrow 81. Such differences occur if the cog 83, through which the rotational movement is transferred to the bottle 25**, does not correspond to the diameter of the bottle.

After the printing process has been terminated, when the components are in the positions indicated in FIG. 3C, the support **27*a* is moved inwards by the cam plate 53 so that the base end of the bottle 25 is released, the bottle then being held only by the mandrel-like carrier 26, moves in the direction of the arrow 81 to the next print station B, and if necessary to additional processing stations between station A and station B. As soon as the support 27*a* is out of engagement with the bottle 25, the movement of the arm 14*a* can be reversed, which is to say it can be pivotted opposite to the direction of the arrow 81 to the other end position under the continued action of cam face 72 and followers 70, so that the support 27*a* and the squeegee 75*a*** are brought to the starting position for the next article that is to be imprinted.

The processes described above also apply to the print stations B and C, the series of movements being completed synchronously in all the printing stations because of the rigid connection between the arms **14*a*–14*c* and the screen slides 62*a*–62*c***.

After it has moved in the direction of the arrow 81 through the final printing station B and any additional processing station incorporated thereafter, for example, drying stations, the carrier 26 is pivotted back into its vertical position by operation of cam face 41p through the toothed rack 38; the bottle can then be removed upright from the machine, at station 84.

If desired the above-described sequence of events may be changed, for example, the sequence can be such that, after termination of each print process at A, B, and C, for example, the article 25 may be tilted into its vertical position by providing for such motion by the cam plate 41, and any subsequent operations, such as drying the ink, are completed with the article in an upright position. The same applies to the beginning of the sequence of operations, although generally speaking it will be expedient to complete all the treatment process with the article in the same position.

It will be understood that if a flat article, rather than the curved surface bottle 25, is to be printed upon, then it is necessary to reverse the positions (not shown) of squeegee 75*a* and silk screen stencil 69*a*. This is because, with a flat article, it is necessary for the silk screen stencil 69*c* to remain stationary with respect to the article to be printed upon and for the squeegee to move relatively to it.

Figure 6:
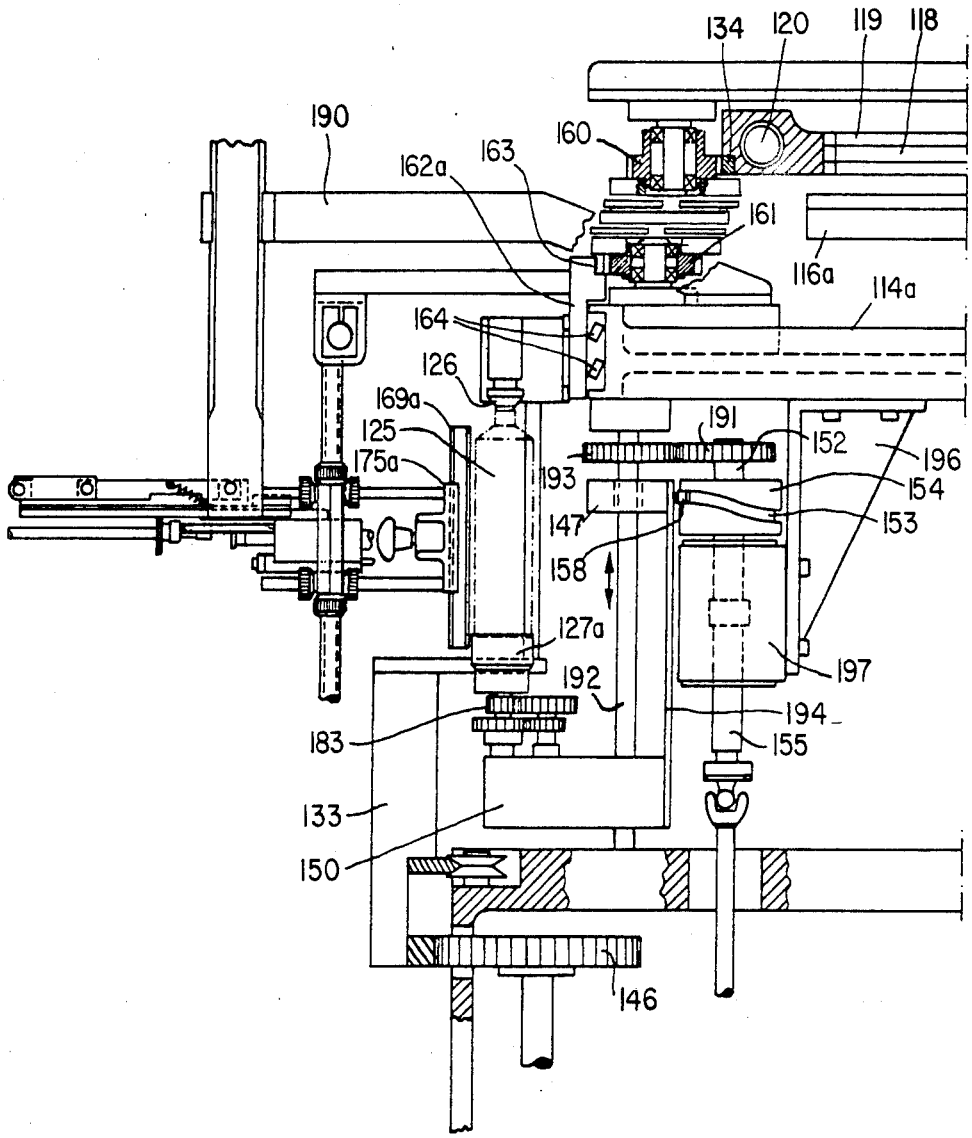
FIG. 6 is a drawing corresponding to FIG. 2 of a silk screen machine having silk screen stencils that are arranged essentially so as to be vertical.

FIG. 6 shows a silk screen machine with a basic construction and fundamental working principles that are the same as those for the silk screen machine shown in FIGS. 1 and 2, so that the same parts perform the same functions although their reference numbers have been augmented by 100.

The sole, significant difference lies in the fact that in the machine as in FIG. 6 the article 125 is imprinted when it is upright. That is to say, that the silk screen stencils 169*a* are also positioned in the vertical plane. The articles 125 are introduced into the machine when upright, in a similar manner to that used in the machine according to FIGS. 1 and 2, and are then held in this position by the carrier 126 and the additional supports 127*a* during the completion of the processes. The carrier 126 does not need to be pivotable in this case. For the remainder, the parts that work together in the print stations are arranged in a similar manner and, insofar as results from the other position of the article 125, are pivotted to 90° relative to the version shown in FIGS. 1 and 2. The squeegee 175*a* is also mounted on an arm 190 that is secured rigidly to the arm 114*a*.

The shaft 155 that drives the cam plate 154 is extended in a short shaft section 152 to which a pinion 191 is rigidly attached, and this engages with another pinion 193 that is fixed to the shaft 192. The gearing contained in the housing 150 is driven by the shaft 192 so that the support 127*a* can be rotated about the longitudinal axis of the article 125. Since the gearing located in the housing 150 is moved back and forth parallel to the longitudinal axis of the article 125 together with the support 127*a*, the connection between the shaft 192 and the gearing within the housing 150 is configured, in conventional manner, so that a back and forth movement of the gearing relative to the shaft 192 is possible. The transfer of this back and forth motion is effected through an extension 194 attached on the housing 150, said extension 194 supporting a cam follower 158 that engages in the cam plate 153. At the free end of the extension 194 there is a guide block 147 in addition to the cam follower 158 that is guided by the shaft 192; this guide block 147 can slide relative to the shaft 192.

As with the embodiment shown in FIGS. 1 and 2, there are universal joints incorporated in the shaft 155 and these make it possible for the end section of the shaft 155 that faces the cam 154 to follow the back and forth radial movement of the arm 114*a* to which a mounting 196 is secured, said mounting supporting a guide block 197 in which the end section of the shaft 155 is supported.

Figure 5:
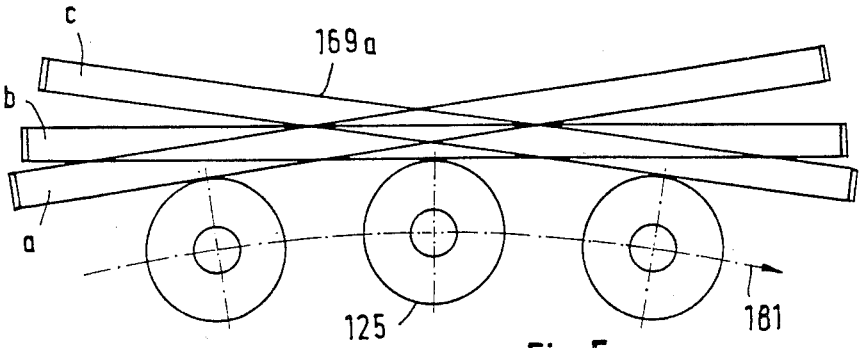
FIG. 5 is a plan view corresponding to FIG. 4 of a silk screen stencil in an essentially vertical plane, in three successive positions during the printing process.

In the version that is shown in FIG. 6, it is also necessary to adapt the position of the silk screen stencil 169*a* during the printing process to the changing angular position of the article 125. This is shown in FIG. 5 where, as in FIG. 4, it is assumed, for convenience of illustration, that the silk screen stencil 169*a* only undergoes a pivotting movement on arm 114*a* without being displaced simultaneously in the direction of its longitudinal axis perpendicular to the axis of rotation of the bottle 125. Thus, the position of the stencil 169*a*, in the direction of the circumference of the machine, remains unchanged since, under the conditions cited above, it undergoes no displacement in the direction of the track along which the article 125 is moved continuously even during the printing process. Thus, according to FIG. 5, it is pivotted only from the start position a, through a middle position b, to an end position c, this being done in coordination with the movement—which takes place simultaneously—of the bottle 125 in the direction of the arrow 181, such that the principal plane of the silk screen stencil 169*a* is always essentially tangential to the surface that is to be imprinted and in contact with this. In the same way as in the version shown in FIGS. 1 and 2, this is achieved very simply in that the silk screen stencil 169*a* can be moved along a linear guide correspondingly to the linear guide 83 on the face side of the arm 114*a*, relative to this without, however, taking part in the pivotting movement of the arm 114*a* that takes place during the printing process synchronously with the article 125.

Unlike the exemplary version shown in the drawings, it is to be understood that the arrangement could be such that the articles can be introduced into the machine when horizontal and removed horizontal from the machine after processing has been completed.

In addition, it is possible to use a different type of carrier in place of the mandrel-like carrier 26, 126; as an example, this can be in the form of a sleeve into which the neck of the bottle is inserted and grasped in a suitable manner by the sleeve. The carriers can also be in the form of tongs, or grippers. The specific configuration will depend on the particular article that is to be imprinted.

It applies to all the versions that, because of the continuous movement of the article within the machine according to the present invention it is possible to achieve very high throughput rates. If, as in the exemplary versions that are shown in the drawings, the supports that hold the articles at the base are provided solely in the processing stations, it will be possible to effect considerable cost savings. Naturally, should it be required, for example when imprinting heavy articles, it is possible to incorporate a base support corresponding to the supports 27*a*–27*c* with each mandrel-like carrier, which would then be supported by the ring 33 or a mounting connected with it, since under the conditions described above these too would move continuously with the carriers 26.

What I claim as my invention is:

1. A machine for printing articles by silk screening at at least one print station, comprising:

a circular track;

means for moving articles to be printed and at least part of which are cylindrical continuously along said track about a track axis with the articles positioned with the surface to be printed in the plane of movement along said track;

means for mounting a squeegee substantially linearly along the cylindrical part of the article parallel with the cylindrical axis of the article and for moving said squeegee about said track axis in the same direction as the article that is to be printed;

means for rotating the article around the cylindrical axis thereof;

means for mounting a silk screen stencil with the stencil between the squeegee and the article and in line contact with the cylindrical part of the article parallel to the cylindrical axis therof for permitting the article and the squeegee to move along said stencil in the directions of the longitudinal dimension of the image pattern of the silk screen stencil for printing the image pattern on the cylindrical part of the article; and means for moving said silk screen stencil for pivoting said silk screen stencil for maintaining the line of contact of the silk screen stencil with the article being printed upon in the same angular position relative to the longitudinal dimension of the image pattern of the silk screen stencil during movement of the article along said circular track during the printing process.

2. A machine according to claim 1 in which the cylindrical axes of the articles to be printed upon are essentially horizontal during the printing.

3. A machine according to claim 1 in which said means for moving articles comprises at least one carrier for carrying an article by one end and movable around said track.

4. A machine according to claim 3 further comprising at least one support spaced from said carrier a distance corresponding to the length of an article to be printed upon for holding the other end of the article, and means for moving said support synchronously with the carrier at least while the screen stencil is engaged with the article.

5. A machine as claimed in claim 4 in which there are a plurality of carriers each for carrying an article, and a plurality of supports, one associated with each carrier and movable with the corresponding carrier along the entire track.

6. A machine as claimed in claim 4 in which said means for moving said support comprises means for moving said support independently of said carrier and for moving said support synchronously with the carrier while the screen stencil is engaged by the article and thereafter returning said support to the position where the article first engages the screen stencil, and further comprises means for disengaging said support from the article at the end of the engagement with said screen stencil and engaging said support with a subsequent article at the position where the subsequent article engages said screen stencil.

7. A machine as claimed in claim 4 in which said carrier and said support are rotatable around the longitudinal axis of the article held between them.

8. A machine as claimed in claim 3 further comprising a ring on which said carrier is supported and a shaft on said track axis around which said ring is rotatably mounted.

9. A machine as claimed in claim 4 further comprising a ring on which said carrier is supported and a shaft on said track axis around which said ring is rotatably mounted, and a further carrier movable on a circular path that runs parallel to said ring and on which said support and said squeegee are mounted for movement back and forth along said parallel circular path.

10. A machine as claimed in claim 9 in which said support is reciprocally slidable in the direction of the cylindrical axis of the article for being engaged with and disengaged from the article.

11. A machine as claimed in claim 9 further comprising a support arm having one end pivotally mounted around said shaft axis and having said squeegee mounted on the other end thereof.

12. A machine as claimed in claim 3 further comprising means for driving said carrier and means for pivoting said silk screen stencil independently of said drive means for the associated carrier.

13. A machine as claimed in claim 1 in which said means for moving the articles comprises at least one carrier, a ring on which said carrier is supported, said carrier being mounted on said ring for swinging from a position in which the article carried by said carrier is perpendicular to the plane of movement to a position where the article lies in the plane of movement, whereby an article can be picked up from a vertical position and swung to a horizontal position for printing, and then swung back to a vertical position for discharge.

14. A method for printing articles by silk screening at at least one print station, comprising:

moving articles to be printed and at least part of which are cylindrical continuously along a circular track about a track axis with the articles positioned with the surface to be printed in the plane of movement along said track;

mounting a squeegee substantially linearly along the cylindrical part of the article parallel with the cylindrical axis of the article and moving said squeegee about said track axis in the same direction as the article that is to be printed;

rotating the article around the cylindrical axis thereof;

mounting a silk screen stencil with the stencil between the squeegee and the article and in line contact with the cylindrical part of the article parallel to the cylindrical axis thereof for permitting the article and the squeegee to move along said stencil in the direction of the longitudinal dimension of the image pattern of the silk screen stencil for printing the image pattern on the cylindrical part of the article; and pivoting said silk screen stencil for maintaining the line of contact of the silk screen stencil with the article being printed upon in the same angular position relative to the longitudinal dimension of the image pattern of the silk screen stencil during movement of the article along said circular track during the printing process.

15. A method as claimed in claim 14 in which the article is held essentially horizontally as it is moved along said track.

16. A method as claimed in claim 14 in which the articles are first picked up from a position in which their cylindrical axes are essentially vertical, and they are then brought into a position in which their cylindrical axes are essentially horizontal, and after the conclusion of the screen printing they are pivoted back to a position in which their cylindrical axes are essentially vertical.

17. A method as claimed in claim 14 further comprising holding the article at one end by a carrier and holding it at the other end by a support during at least a portion of the distance it is moved along the track, and moving said support synchronously with the carrier at least while it supports the article.

18. A method as claimed in claim 17 in which the step of rotating the article comprises rotating the support and the associated carrier around the cylindrical axis of the article.

19. A method as claimed in claim 17 in which the step of moving the support comprises moving the support synchronously with the carrier during the screen printing and then moving the support back along the corresponding part of the track to engage a subsequent article to be printed upon.

20. A method as claimed in claim 17 in which said support is moved with and supports the article only during screen printing.

* * * * *